US011680773B2

(12) United States Patent
Roman et al.

(10) Patent No.: US 11,680,773 B2
(45) Date of Patent: Jun. 20, 2023

(54) DEVICES AND METHODS OF RAPIDLY ZEROING A RIFLESCOPE USING A TURRET DISPLAY

(71) Applicants: Kendyl A Roman, Sunnyvale, CA (US); John Livacich, Sunnyvale, CA (US)

(72) Inventors: Kendyl A Roman, Sunnyvale, CA (US); John Livacich, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 0 days.

(21) Appl. No.: 17/868,738

(22) Filed: Jul. 19, 2022

(65) Prior Publication Data

US 2022/0364828 A1 Nov. 17, 2022

Related U.S. Application Data

(63) Continuation-in-part of application No. 16/222,850, filed on Dec. 17, 2018, now Pat. No. 11,391,545.

(51) Int. Cl.
*F41G 1/38* (2006.01)
*F41G 1/54* (2006.01)

(52) U.S. Cl.
CPC *F41G 1/38* (2013.01); *F41G 1/54* (2013.01)

(58) Field of Classification Search
CPC ..... F41G 3/2605; F41G 3/06; F41G 3/065; F41G 3/12; F41G 1/38
USPC ..... 434/19; 42/1.02, 1.01, 1.03, 1.05, 111, 42/113, 119, 120, 122, 123; 89/41.05
See application file for complete search history.

(56) References Cited

U.S. PATENT DOCUMENTS 6,862,832 B2 * 3/2005 Barrett ..... F41G 1/38 42/119
6,886,287 B1 * 5/2005 Bell ..... F41G 11/001 33/366.11
7,624,528 B1 * 12/2009 Bell ..... F41G 1/38 42/122
7,738,082 B1 * 6/2010 Peters ..... F41G 3/06 356/4.01
7,905,046 B2 * 3/2011 Smith, III ..... F41G 3/06 235/404
8,230,636 B1 * 7/2012 Swan ..... F41G 11/003 33/297
8,240,077 B2 * 8/2012 Holmberg ..... F41G 11/003 42/114

(Continued)

*Primary Examiner* — John Cooper

(57) ABSTRACT

A turret display device is used for rapidly zeroing a riflescope. The turrets on an improved riflescope provide a turret position signal. A display of the turret display device comprises turret display cross hairs displayed relative to a target icon. When the turret display device receives a turret position signal, turret display cross hairs move to show the relative movement as indicated by the received turret position signal. When a distance is processed by the turret display device, the turret display cross hairs move to show an aiming point relative to a target icon based on the current zero of the riflescope. The user zeroes the riflescope to any distance by turning the turrets until the turret display cross hairs are centered for the desired distance. In some embodiments the turret display device is integrated into a hand held rangefinder, smart phone, or riflescope. A riflescope having turrets which each provide a turret position signal.

20 Claims, 10 Drawing Sheets

(56) References Cited

U.S. PATENT DOCUMENTS 8,336,776 B2 * 12/2012 Horvath ..... F41G 3/142 235/407
8,414,298 B2 * 4/2013 D'Souza ..... F41G 1/54 434/22
9,091,507 B2 * 7/2015 Paterson ..... F41G 1/38
9,127,911 B2 * 9/2015 Varshneya ..... G01S 17/95
9,151,570 B2 * 10/2015 Plaster ..... F41G 1/38
9,250,035 B2 * 2/2016 Sullivan ..... F41G 1/44
9,766,040 B2 * 9/2017 Roman ..... F41G 3/165
10,415,933 B1 * 9/2019 Kleck ..... F41G 3/06
10,534,166 B2 * 1/2020 Summerfield ..... G02B 27/142
10,907,934 B2 * 2/2021 York ..... G06F 3/0484
11,060,816 B2 * 7/2021 York ..... F41G 1/38
2004/0231220 A1 * 11/2004 McCormick ..... F41G 3/06 42/120
2007/0137088 A1 * 6/2007 Peters ..... F41G 3/142 42/106
2007/0234626 A1 * 10/2007 Murdock ..... F41G 1/38 42/142
2007/0277421 A1 * 12/2007 Perkins ..... F41G 1/473 42/122
2011/0114725 A1 * 5/2011 Young ..... F41G 3/06 235/407
2012/0117848 A1 * 5/2012 Cox ..... F41G 1/38 42/130
2015/0247702 A1 * 9/2015 Davidson ..... F41G 1/473 42/122
2016/0025455 A1 * 1/2016 Paterson ..... F41G 1/38 42/122
2016/0069644 A1 * 3/2016 Bell ..... F41G 3/02 89/204
2016/0084617 A1 * 3/2016 Lyren ..... F41G 3/142 42/135
2016/0091282 A1 * 3/2016 Baker ..... H04N 23/661 348/158
2016/0138890 A1 * 5/2016 Hofmann ..... F41G 1/38 345/59
2016/0169625 A1 * 6/2016 Richards ..... F41G 3/06 348/333.02
2016/0265880 A1 * 9/2016 Maryfield ..... G02B 23/18
2017/0284771 A1 * 10/2017 Roman ..... F41G 1/473
2020/0049455 A1 * 2/2020 Hamilton ..... F41G 1/38
2022/0065586 A1 * 3/2022 Bellah ..... F41G 3/065

* cited by examiner

DEVICES AND METHODS OF RAPIDLY ZEROING A RIFLESCOPE USING A TURRET DISPLAY

This application is a continuation in part of U.S. patent application Ser. No. 16/222,850 filed on 17 Dec. 2018, U.S. Pat. No. 11,391,545

BACKGROUND

Field of the Invention

The present invention relates to zeroing or sighting in a riflescope using a turret display.

Description of Prior Art

Rifles, handguns, and crossbows have been used for sport, hunting, and military.

Balls and/or bullets are typically shot from a rifle or gun using the arms to aim and sight by aligning the riflescope reticle with the target.

An arrow may be shot from a crossbow having a crossbow scope similar to a riflescope.

Bullets, balls and arrows, when fired, follow a ballistic trajectory. Such projectiles, which are not self-propelled, move through air according to a generally parabolic (ballistic) curve due primarily to the effects of gravity and air drag.

Riflescopes 302 are shown in FIG. 3A and FIG. 3C and are shown attached to a hunting rifle 302 in FIG. 3B and to a military rifle 302 in FIG. 3D, respectively.

Riflescopes conventionally have been fitted with reticles of different forms. Some have horizontal and vertical scope cross hairs 290. Others reticles such as mil-dot add evenly spaced dots for elevation and windage along the scope cross hairs 290. Various reticles, such as SR; Multi Aim Point (MAP); and Dot are provided. These reticles are fixed in that the display does not change based on range information. Also, these reticles indicate the approximate holdover position in that they are positioned under the center of the scope, i.e. below where the scope cross hairs 290 intersect. The holdover positions are not necessarily precise, for example, for a specific rifle and ammunition, but are approximated for the general case.

Hunters and other firearm and crossbow users commonly utilize handheld rangefinders (see e.g. device 10 in FIG. 2) to determine ranges to targets. Generally, handheld rangefinders utilize lasers to acquire ranges for display to a user. Utilizing the displayed ranges, the user makes sighting corrections to facilitate accurate shooting.

In reference to FIG. 1, a handheld rangefinder device 10 generally includes a range sensor 12 operable to determine a first range to a target, a tilt sensor 14 operable to determine an angle to the target relative to the device 10, and a computing element 16, coupled with the range sensor 12 and the tilt sensor 14, operable to determine a holdover value based on the first range and the determined angle. The range information is displayed on a display 30. A housing 20 contains the elements of the device 10. Many rangefinders show the first linear range to the target and also show an angle and a second range, which represents the horizontal distance to the target. Handheld rangefinders, some riflescopes, and other optical devices may comprise a laser range sensor and an inclinometer.

The range information is superimposed over the image that is seen through the optics. FIG. 2 shows an exemplary handheld rangefinder device 10 with a display 30 in the optical path.

With convention rangefinder and a rifle there is no correlation between the display of the rangefinder and the user's individual riflescope. To make an effective shot requires several steps. All of the movement and time taken during these steps will likely be noticed by the target and allow the target an opportunity to move resulting in having to repeat the process or miss the shot altogether.

Further in order to show an accurate aiming point a riflescope needs to be calibrated to a specific rifle, crossbow, or other firearm; the characteristics of the specific projectile or ammunition; and the environmental conditions such as wind, atmospheric pressure, humidity, and temperature. Riflescope calibration is performed by shooting the rifle 302 with specific ammunition, in specific environmental conditions, and adjusting the center of the scope, i.e. where the scope cross hairs 290 appear relative to the optical image coming through the riflescope 302. Elevation (up and down) is adjusted with an elevation turret 274 (see FIG. 3A and FIG. 3C). Windage (left and right) is adjusted with a windage turret 276 (see FIG. 3A and FIG. 3C). The location of the reticle with riflescope and the means for adjusting the optical image are well known to those of skill in the art. Typically the turrets apply pressure to a moveable tube within riflescope. Optical elements mounted in the tube move to change the image presented to the user.

Once a riflescope is calibrated to all these factors, most users are hesitant to make any changes to the positions of the turrets in the fields. Instead they leave the scope turrets alone and try to make adjustments in their mind based on differences in the various conditions and characteristics that have changed. A small number of advanced users, such as high-end hunters, and military snipers, are comfortable making changes to the scope calibration to adjust for changes in altitude, wind, or distance. Doing so requires complex calculations and accurate data. This allows them to recalibrate in the field so that the scope cross hairs are accurate for use as an aiming point centered on the target.

What is needed are systems and methods of rapidly calibrating a riflescope in the field wherein the user is shown the position of the riflescope turrets and how they should be adjusted, so the user can use the scope cross hairs as centered on the target.

SUMMARY OF THE INVENTION

The present invention solves the above-described problems and provides a distinct advance in the art of riflescope calibration and use. More particularly, the invention provides a display that shows the user where the riflescope cross hairs are positioned relative to where they need to be moved, using the turrets, in order to use the scope cross hair centered on the target so that the use can simply and clearly visualize where to aim. Such information facilitates accurate, effective, and safe firearm use.

In multiple embodiments, a turret display device indicates the position of the riflescope cross hairs by displaying turret display cross hairs.

In multiple embodiments, a turret display device provides dynamic indication of the movement of the riflescope cross hairs, as the turrets turn, so that the user can rapidly center the riflescope cross hairs.

In multiple embodiments, a turret display device provides dynamic indication of how to move the riflescope cross hairs in order to calibrate the riflescope to the specific characteristics of the rifle, ammunition, and environments conditions.

In some embodiments of a turret display device, the riflescope is calibrated using a relative target.

In some embodiments of a turret display device, the riflescope is calibrated using a relative target icon in the turret display to provide the indication of movement of the riflescope cross hairs, as the turrets turn.

In some embodiments of a turret display device, the riflescope is calibrated using a relative target icon in the turret display to provide the indication of when the riflescope cross hairs are centered.

In some embodiments of a turret display device, a reference image shows the position and movement of the riflescope cross hairs.

In some embodiments of a turret display device, the reference image is a user selectable image.

In some embodiments of a turret display device, the reference image is a specific game target.

In some embodiments of a turret display device, the reference image is a deer.

In an embodiment, the turret display device is integrated with the housing of a riflescope and is electrically connected to the turret position signals.

In multiple embodiments, the turret display device communicates wirelessly to receive the turret position signals.

In an embodiment, the turret display device is attached to the housing of a riflescope.

In an embodiment, the turret display device is attached to the housing of a handheld rangefinder device.

In an embodiment, the turret display device is integrated with the handheld rangefinder device that communicates wirelessly to receive the turret position signals.

Accordingly, it is an objective of the present invention to provide devices and methods of rapidly calibrating a riflescope in the field wherein the user is shown the position of the riflescope turrets and how they should be adjusted, so the user can use the scope cross hairs as centered on the target.

Other aspects and advantages of the present invention will be apparent from the following detailed description of the preferred embodiments and the accompanying drawing figures.

OBJECTS AND ADVANTAGES

Accordingly, the present invention includes the following advantages:

a) To provide a turret display device used for rapidly zeroing a riflescope.
b) To provide turrets on a riflescope which provide turret position signals.
c) To display turret display cross hairs relative to a target icon.
d) When the turret display device receives a turret position signal, to move the turret display cross hairs to show the relative movement as indicated by the received turret position signal.
e) When a distance is processed by the turret display device, to move the turret display cross hairs to show an aiming point relative to a target icon based on the current zero of the riflescope.
f) To provide a method for calibrating a riflescope to a predetermined sight in distance.
g) To provide a method of using a turret display device to rapidly zero a riflescope at any distance.
h) To provide a digital display that indicates the position of the riflescope cross hairs by displaying turret display cross hairs.
i) To turret display device that works in combination with a relative target to determine the ballistic curve for a specific firing device and projectile, such as a specific rifle and ammunition.

DRAWING FIGURES

A preferred embodiment of the present invention is described in detail below with reference to the attached drawing figures, wherein.

Figure 1:
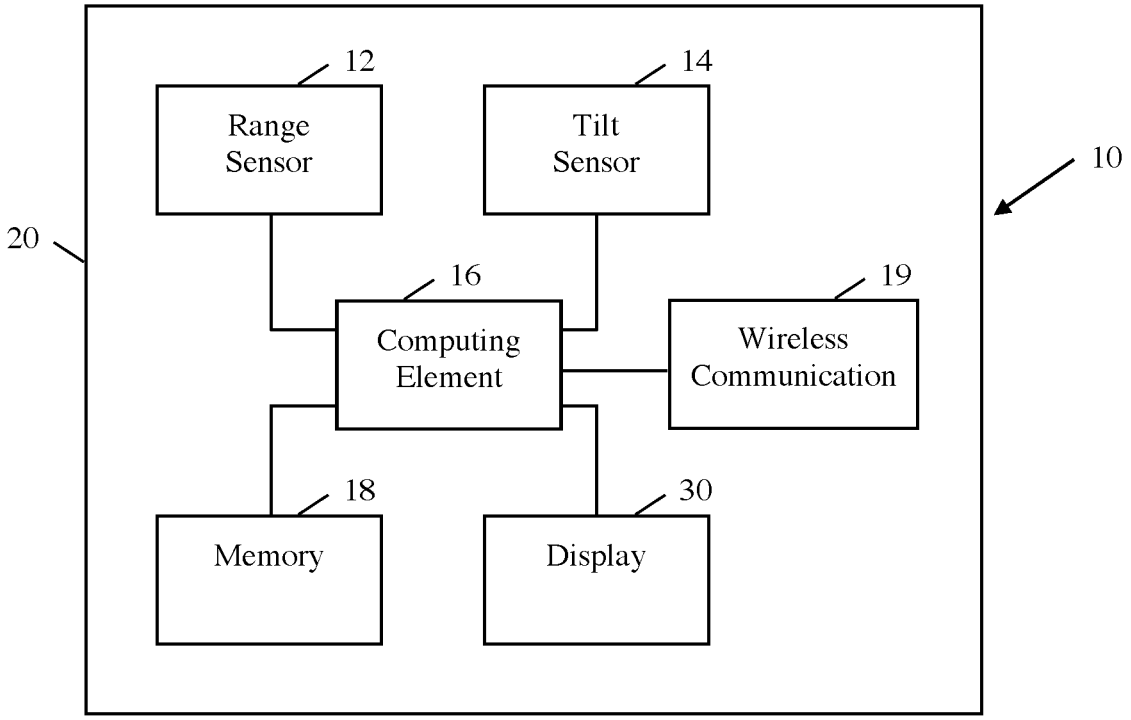
FIG. 1 is a block diagram of an improved rangefinder device.

The drawing figures do not limit the present invention to the specific embodiments disclosed and described herein. The drawings are not necessarily to scale, emphasis instead being placed upon clearly illustrating the principles of the invention.

| REFERENCE NUMERALS IN DRAWINGS | |
|---|---|
| 10 | rangefinder device |
| 11 | iPhone (smartphone) |
| 12 | range sensor |
| 14 | tilt sensor |
| 16 | computing element |
| 18 | memory |
| 19 | wireless communication |
| 20 | housing |
| 30 | display |
| 31 | high-resolution display |
| 32 | inputs |
| 274 | elevation turret |
| 276 | windage turret |
| 290 | scope cross hairs |
| 300 | rifle |
| 302 | riflescope |
| 400 | turret display device |
| 490 | turret display cross hairs |
| 900 | cross hairs |
| 910 | distance indicator |
| 914 | horizontal distance indicator |
| 1000 | relative aiming point |
| 1002 | reference image |
| 1042 | sight in indicator |
| 1054 | deer reference image |
| 1100 | relative target |

-continued

| REFERENCE NUMERALS IN DRAWINGS | |
|---|---|
| 1120 | relative target icon |
| 1130 | shot mark |
| T | target |

DESCRIPTION OF THE INVENTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Improved Rangefinder

FIG. 1 shows an improved rangefinder device 10, which, in addition to the conventional components, comprises a wireless communications element 19 such as Near Field Communication (NFC), Bluetooth, or WiFi. The application of wireless communications 19 will be discussed below.

Improved Scopes

Figure 3A:
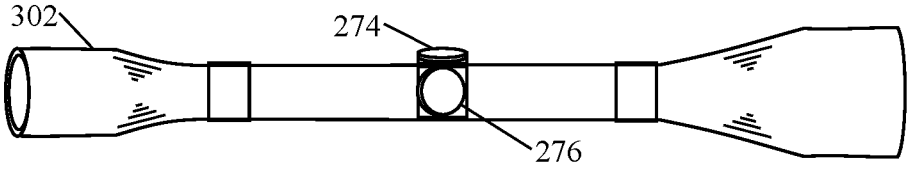
FIG. 3A shows a riflescope.
Figure 3B:
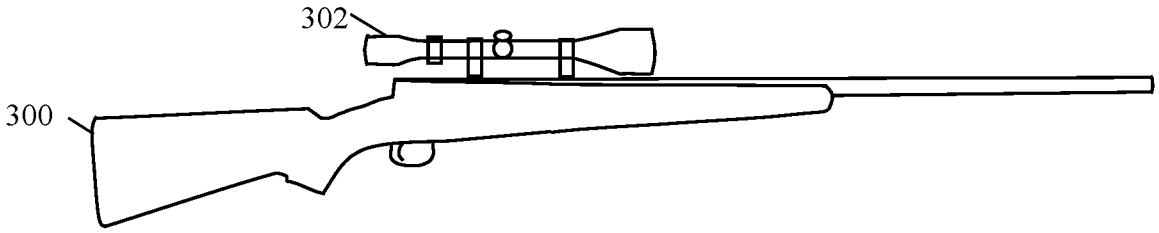
FIG. 3B shows a riflescope mounted on a rifle.
Figure 3C:
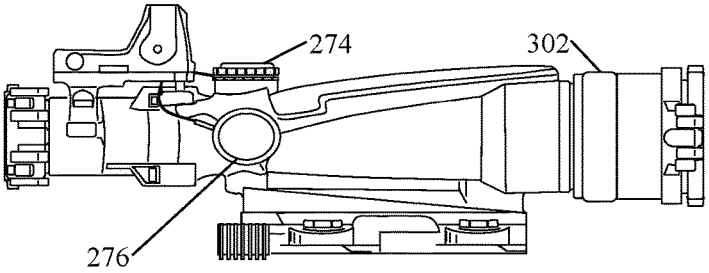
FIG. 3C shows a military riflescope.
Figure 3D:
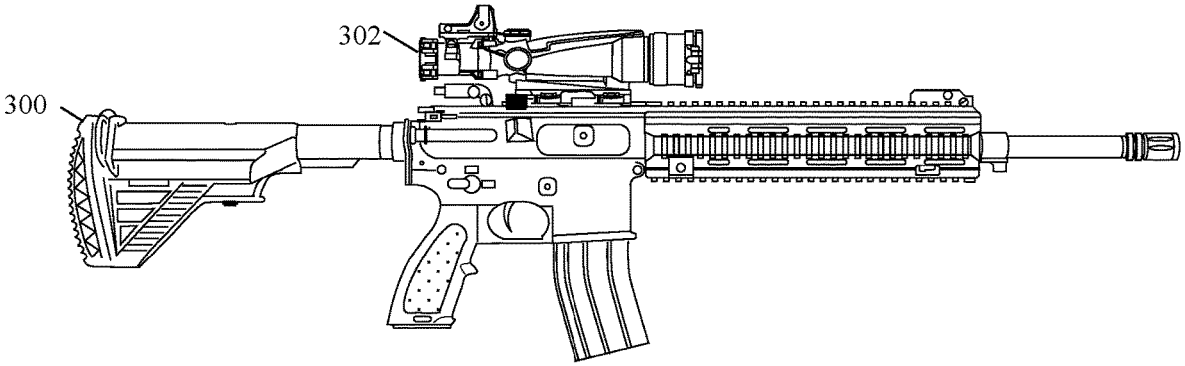
FIG. 3D shows a military riflescope mounted on a military rifle.

In improved riflescopes 302, shown in FIG. 3A and FIG. 3C, each of the turrets, elevation turret 274 and windage turret 276, provides an electronic signal that indicates the physical position of the respective turret, i.e. the turret position signal. The signal can be provided by the turret or by a sensor. Examples of sensors including a spring that measures the pressure changes as the turret is turned; a optical sensor that detect movement of the turret lines or barcode incorporated on the edge of the turret; or a sensor which detects how deep the turret screw is in its respective channel.

Figure 6:
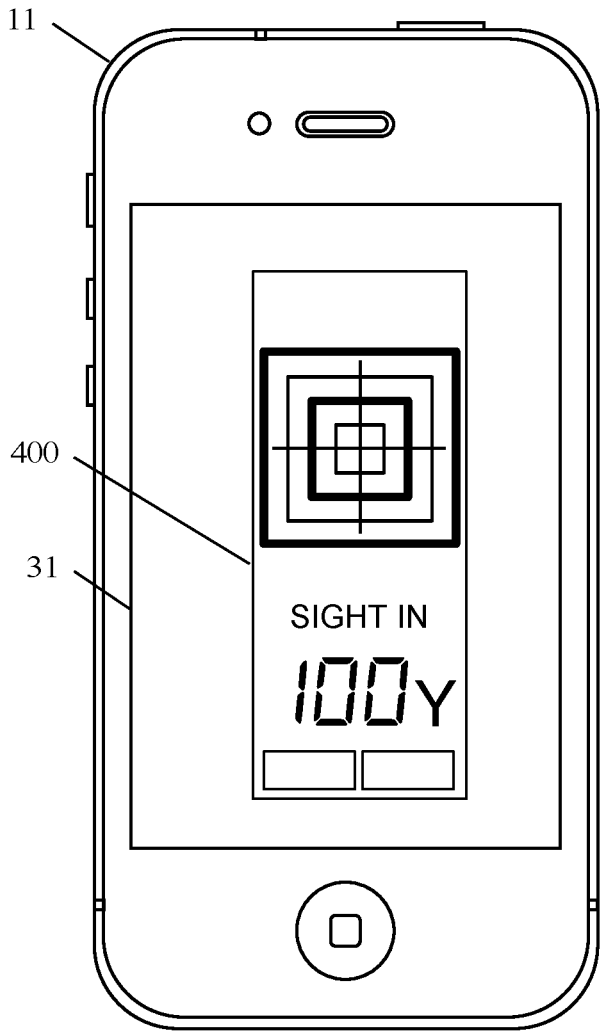
FIG. 6 shows a turret display device embodied in a high-resolution display of an exemplary smart phone.
Figure 7:
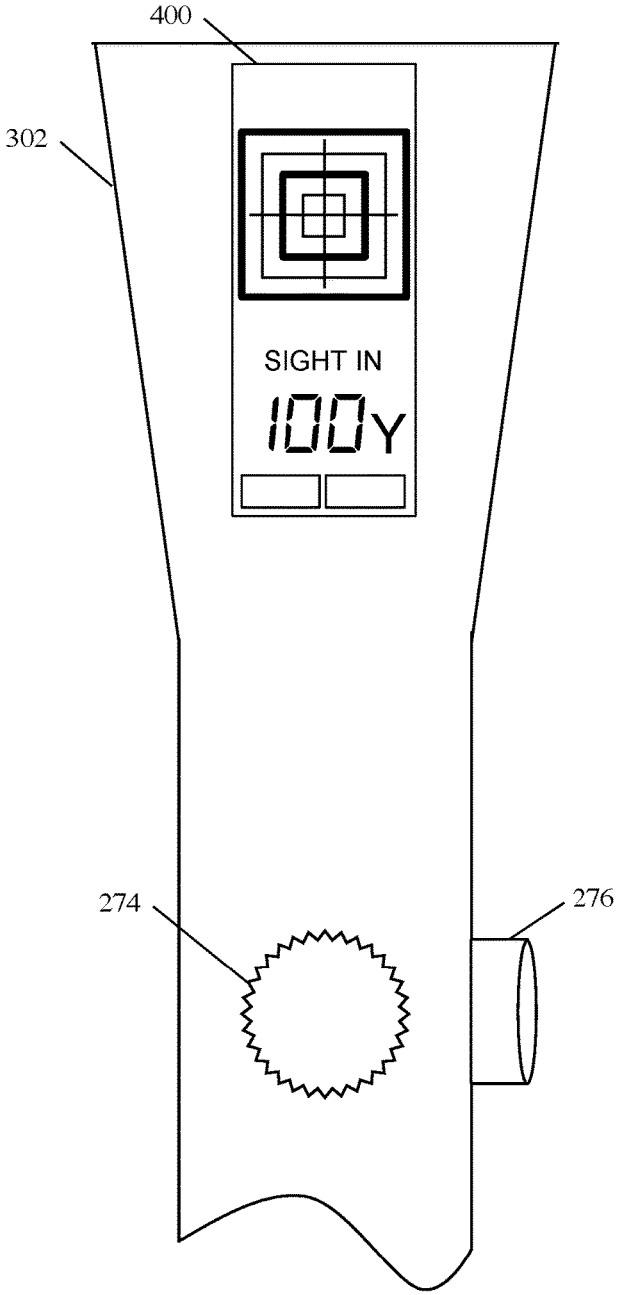
FIG. 7 shows a turret display device integrated into the housing of a riflescope.
Figure 10:
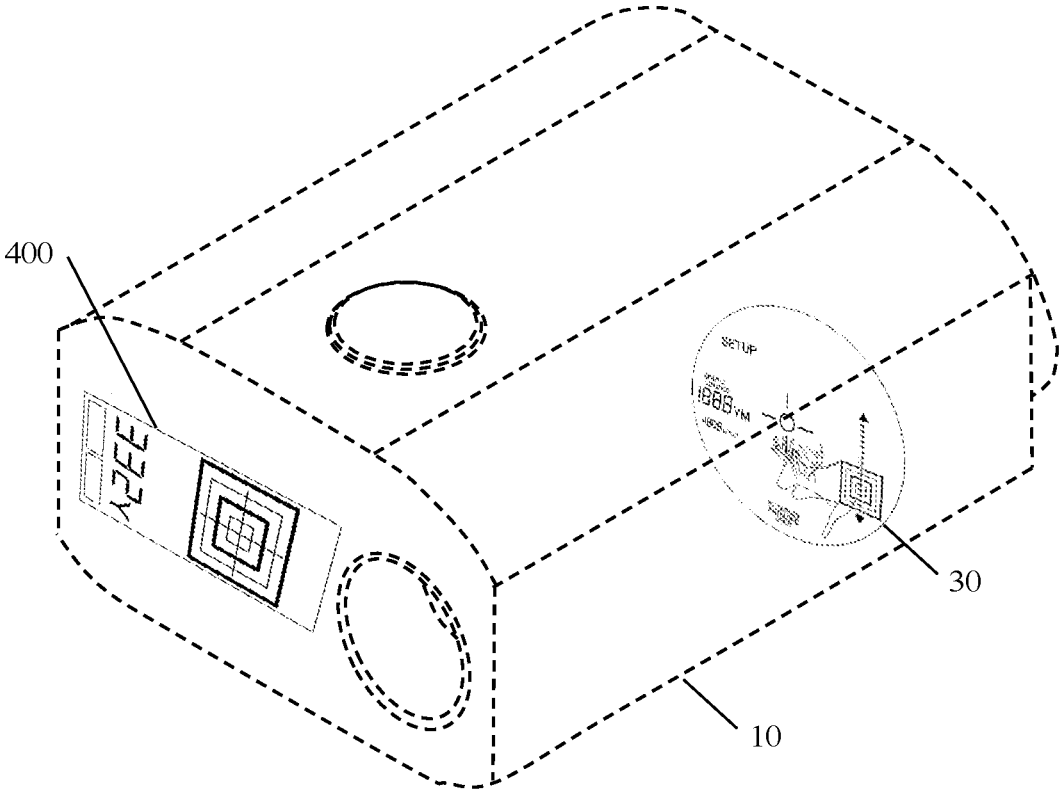
FIG. 10 shows the turret display device integrated into the housing of a handheld rangefinder device.

Some embodiments of improved riflescopes 302 (as shown in FIG. 3A and FIG. 3C), in addition to the conventional components, comprise a wireless communications element such as Near Field Communication (NFC), Bluetooth, or WiFi. Each of the turrets provides its respective turret position signal to another device, such as an improved rangefinder (as shown in FIG. 1 or FIG. 10), a smart phone (e.g. iPhone 11 as shown in FIG. 6), or an improved riflescope 302 with integrated turret display device 400 (as shown in FIG. 7).

Rangefinder Device

Figure 2:
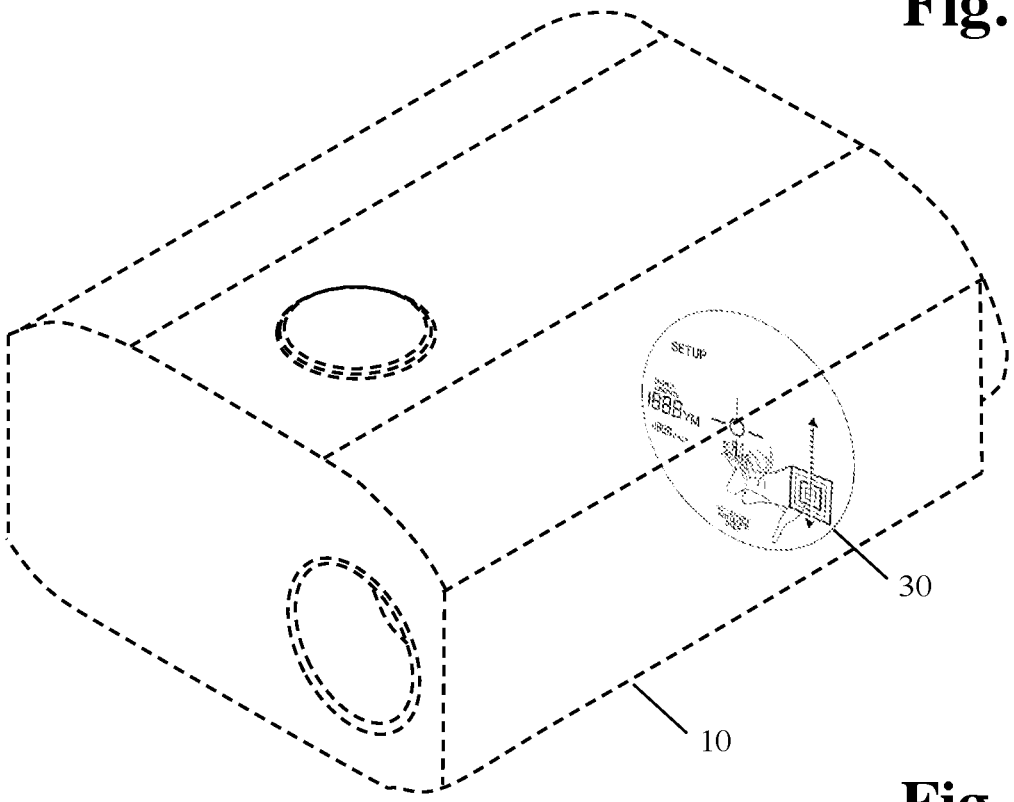
FIG. 2 shows an exemplary handheld rangefinder device.

FIG. 2 is a rear perspective view of an exemplary range finding device 10, shown as a handheld laser rangefinder with a display 30 visible through an eyepiece.

FIG. 1 shows the internal components. The portable handheld housing 20 houses the range sensor 12, tilt sensor 14, computing element 16, memory 18, wireless communications 19, and a display 30. Other elements desired elements such as one or more inputs, eyepiece, lens, laser emitter, laser detector, etc. may also be found in the housing 20. The handheld housing 20 enables the device 10 be easily and safely transported and maneuvered for convenient use in a variety of locations.

Generally a rangefinder device 10 generally includes a range sensor 12 for determining a first range to a target T, a tilt sensor 14 for determining an angle to the target T, a computing element 16 coupled with the range sensor 12 and the tilt sensor 14 for determining ballistic information relating to the target T based on the first range and the determined angle, a memory 18 for storing data such as ballistic information and a computer program to control the functionality of the device 10, and a portable handheld housing 20 for housing the range sensor 12, the tilt sensor 14, the computing element 16, the memory 18, and other components.

Turret Display Device

Figure 4:
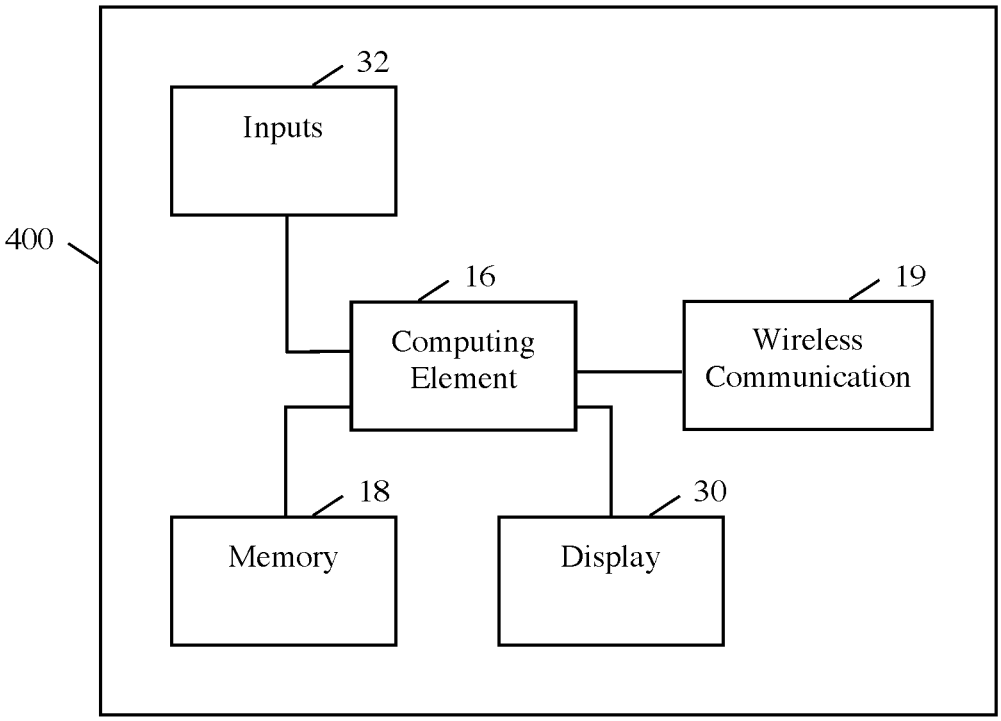
FIG. 4 is a block diagram of a turret display device.

FIG. 4 is a block diagram of a turret display device 400 comprising: a computing element 16, a memory 18, wireless communications 19, a display 30, and inputs 32.

A computer program preferably controls input and operation of the turret display device 400. The computer program includes at least one code segment stored in or on a computer-readable medium residing on or accessible by the turret display device 400 for instructing the computing element 16, display 30, and any other related components to operate in the manner described herein. The computer program is preferably stored within the memory 18 and comprises an ordered listing of executable instructions for implementing logical functions in the turret display device 400. However, the computer program may comprise programs and methods for implementing functions in the turret display device 400 which are not an ordered listing, such as hard-wired electronic components, programmable logic such as field-programmable gate arrays (FPGAs), application specific integrated circuits, conventional methods for controlling the operation of electrical or other computing devices, etc.

Similarly, the computer program may be embodied in any computer-readable medium for use by or in connection with an instruction execution system, apparatus, or device, such as a computer-based system, processor-containing system, or other system that can fetch the instructions from the instruction execution system, apparatus, or device, and execute the instructions.

The turret display device 400 and computer programs described herein are merely examples of a device and programs that may be used to implement the present invention and may be replaced with other devices and programs without departing from the scope of the present invention.

Turret Display

Figure 5:
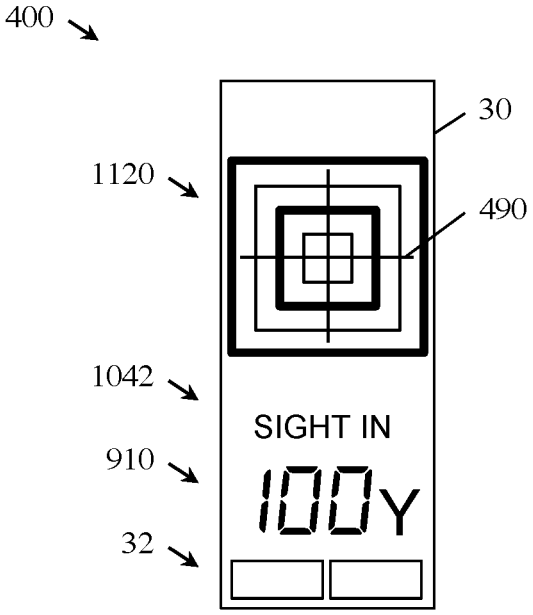
FIG. 5 shows an exemplary turret display device.

FIG. 5 shows an exemplary turret display device 400 having a turret display 30 and inputs 32. Elements of the display 30, include turret display cross hairs 490, distance indicator 910, sight in indicator 1042, and relative target icon 1120. The turret display cross hairs 490 move dynamically as controlled by inputs 32 or wireless communications 19. The distance indicator 910 shows a distance (e.g. in yards or meters). The sight in indicator 1042 is selectively activated to in indicate that the distance shown in the distance indicator 910 is a current sight in distance. The relative target icon 1120 is fixed in the display and provides a relative reference for the turret display cross hairs 490.

Turret displays 30 may be embodied in various devices, such as an improved rangefinder (as shown in FIG. 10), a smart phone (e.g. iPhone 11, as shown in FIG. 6), or an improved riflescope 302 with integrated turret display device 400 (as shown in FIG. 7).

The operation of the turret display device 400 and its display 30 will be discussed below.

Turret Display Device in a Smart Phone or Tablet

FIG. 6 shows a turret display device 400 embodied in a high-resolution display 31 of an exemplary smart phone or tablet, such as iPhone 11. These embodiments have a display 30, which is a high-resolution display 31. Inputs can be virtual buttons implemented in a touch screen of a high-resolution display 31. The computing element 16, memory 18, wireless communications 19 (FIG. 4) may be the CPU, memory, and wireless communications of the smart phone or tablet.

Turret Display Device Integrated in a Riflescope Housing

FIG. 7 shows a turret display device 400 integrated in a housing of an improved riflescope 302. The respective turret position signals may be communicated to the turret display device 400 via wires in the housing, or via the wireless communication 19, from the respective turrets, elevation turret 274 and windage turret 276. The elements of the turret display device 400 are the same as described in reference to FIG. 5.

Operation of the Turret Display Device in Conjunction with the Rapid Zero Riflescope Regardless of the embodiment, i.e. an improved rangefinder (as shown in FIG. 10), a smart phone (e.g. iPhone 11, as shown in FIG. 6), or an improved riflescope 302 with integrated turret display device 400 (as shown in FIG. 7), the basic operation of the a turret display device 400 is the same.

Calibration of the Rapid Zero Riflescope

Figure 8A:
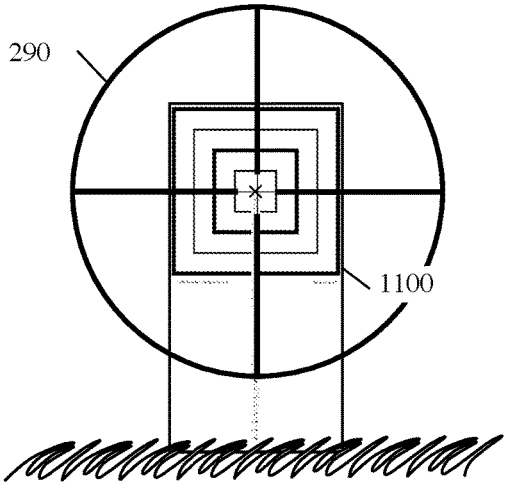
FIGS. 8A through 8C illustrate a method of indicating the turret adjustment.
Figure 8B:
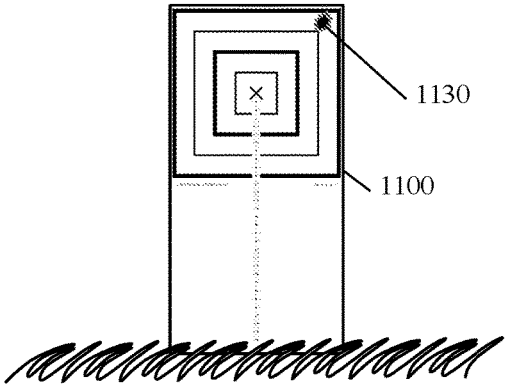
Figure 8C:
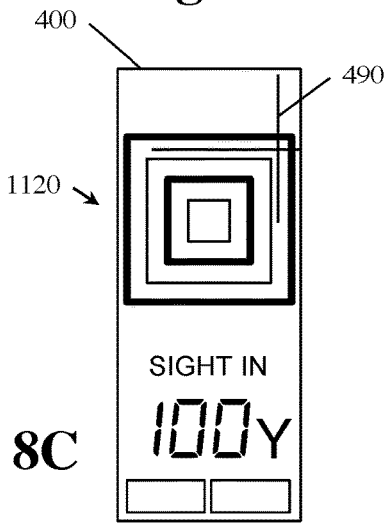

FIGS. 8A through 8C illustrate a method of indicating the turret adjustment to rapidly zero an improved riflescope 302 during calibration. FIG. 8A shows aiming the scope cross hairs 290 at a target T, shown as a paper target with our relative target markings, i.e. a relative target 1100. In this example, the sight in distance is 100 yards. The user aligns the scope cross hairs 290 of the improved riflescope 302 at the center of target, e.g. the relative target 1100, while at a distance of 100 yards from the target. FIG. 8B shows that a shot mark 1130, showing where the shot hit the target. In calibration mode on the turret display device 400, the user sets the sight in distance to 100 yards, and then adjusts the turret display cross hairs 490 visually match the location on the relative target icon 1120 to the location of the shot mark 1130 on the relative target 1100. The scope and the display are now synchronized and exits calibration mode. The user then turns the respective turrets, elevation turret 274 and windage turret 276, until the turret display cross hairs 490 are centered on the relative target icon 1120.

A novel feature of this invention is that as the respective turrets are manually turned, their respective positions are communicated via their respective turret position signals to the turret display device 400 so that the turret display cross hairs 490 move in sync with any movement of either turret. This allows the user to rapidly zero the scope at anytime using the turret display device 400.

Another novel feature of this invention is that the adjustment made to the windage turret provides an indication of the wind. For example, if the rifle were zeroed for 100 yards with no wind, and then calibrated at 100 yards with the current wind, the adjustment would provide an indication of the wind speed, or an indication of how far the current wind moved the projectile over the 100 yards. This wind indication can then be used to calculate a wind speed, for example by the smart phone or tablet 11 or a handheld rangefinder.

Using the Rapid Zero Riflescope

FIGS. 9A through 9D illustrate a method of indicating the turret adjustment to rapidly zero an improved riflescope 302 for use at any distance.

Figure 9A:
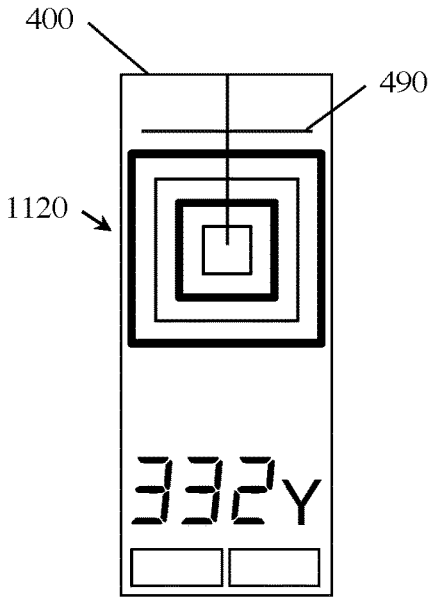
FIGS. 9A through 9D illustrate various steps in the operation of the turret display device.
Figure 9B:
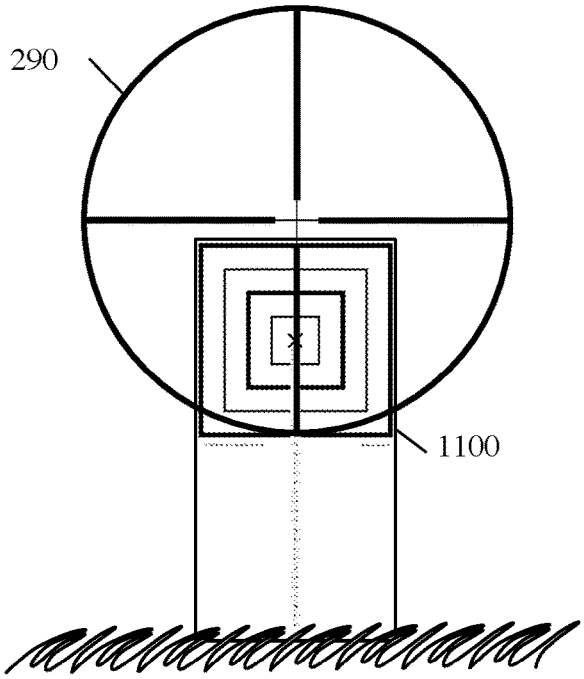

FIG. 9A shows the turret display device 400, after it has been calibrated and when it has received a current distance of 332 yards. The distance can be wirelessly communicated from an improved rangefinder, or can be input using one or more inputs 32 on the turret display device 400. In this example, the turret display cross hairs 490 automatically show where to aim relative to the relative target icon 1120. FIG. 9B shows where to aim the now calibrated riflescope 302 by placing the scope cross hairs 290 in a position that visually matches the relative position on the target, shown as relative target 1100.

Figure 9C:
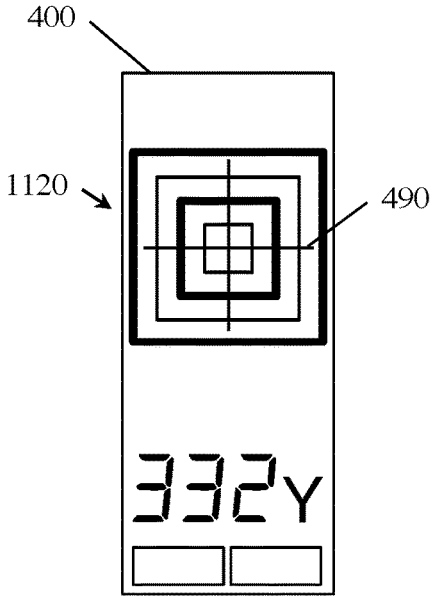
Figure 9D:
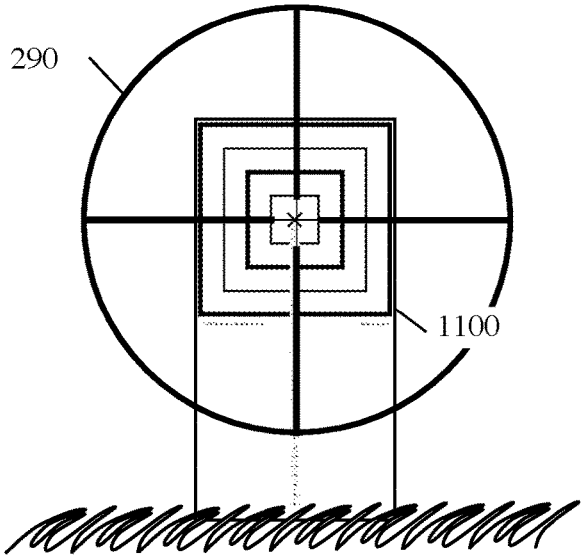

If the user has time, they may rapidly zero the scope for the new distance, in this case 332 yards, by turning the respective turrets, elevation turret 274 and windage turret 276, until the turret display cross hairs 490 are centered on the relative target icon 1120 as shown in FIG. 9C. The improved riflescope 302 is now zeroed at 332 yards and user can aim using the scope cross hairs 290 centered on the target.

A novel features of this invention is that as the respective turrets are manually turned, their respective positions are communicated via their respective turret position signals to the turret display device 400 so that the turret display cross hairs 490 move in sync with any movement of either turret. This allows the user to rapidly zero the scope at anytime to any distance using the turret display device 400. This has the advantage of giving the user greater confidence and accuracy by being about to rapidly adjust the turrets so that the scope cross hairs 290 can always be centered on the target to aim the shot.

Turret Display Device Integrated in a Riflescope Housing

FIG. 10 shows a turret display device 400 integrated in a housing of an improved handheld rangefinder device 10. The respective turret position signals may be communicated to the turret display device 400 via the wireless communication 19, from the respective turrets, elevation turret 274 and windage turret 276, in the improved riflescope 302. The elements of the turret display device 400 are the same as described in reference to FIG. 5.

In this embodiment, the distance can be communicated via wires or via wireless communications from the rangefinder's computing element to the turret display device 400.

The user would range the target and then look at the turret display device 400 to zero the riflescope 302 by turning the elevation turret 274 until the display cross hairs 490 are centered.

Using the Rapid Zero Riflescope with a Relative Aiming Point Rangefinder

FIGS. 11A through 11F illustrate use the turret display device 400 in conjunction with a Relative Aiming Point Rangefinder.

Figure 11A:
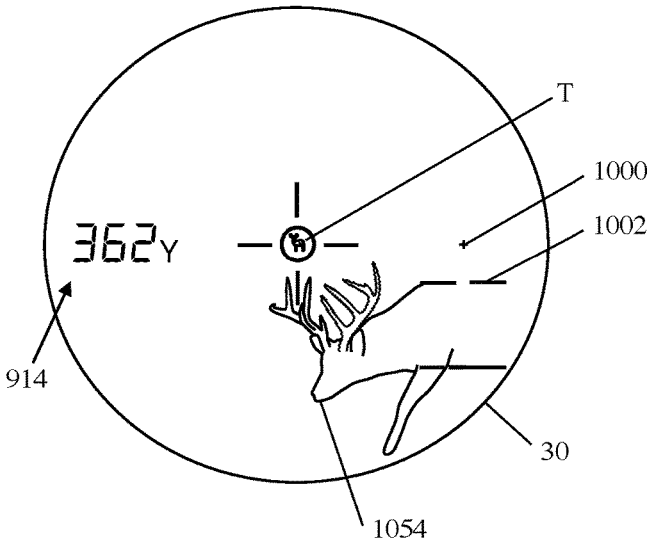
FIGS. 11A through 11F illustrate various steps in the operation of the turret display device with a improved rangefinder.

FIG. 11A shows a display 30 of a Relative Aiming Point Rangefinder, with an exemplary target T located at a distance of 362 yards, as shown by the horizontal distance indicator 914. A relative aiming point 1000 is displayed relative to a reference image 1002, in this case shown as a deer reference image 1054.

Figure 11B:
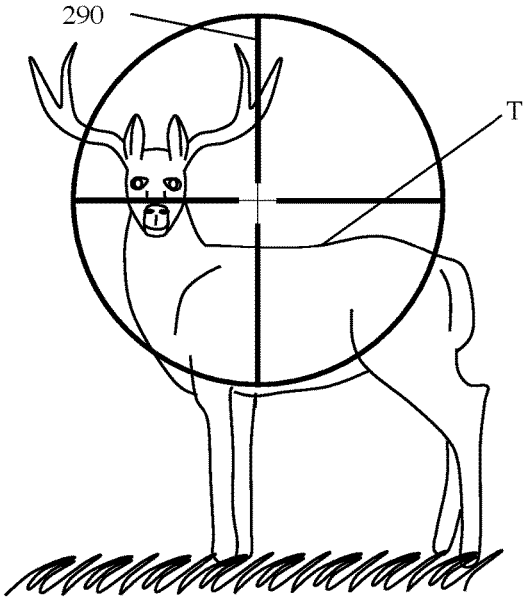

FIG. 11B shows where to aim the calibrated riflescope 302 by placing the scope cross hairs 290 in a position that visually matches the relative aiming point 1000 (in FIG. 11A). In this example the riflescope 302 has been calibrated at a sight in distance of 100 yards.

Figure 11C:
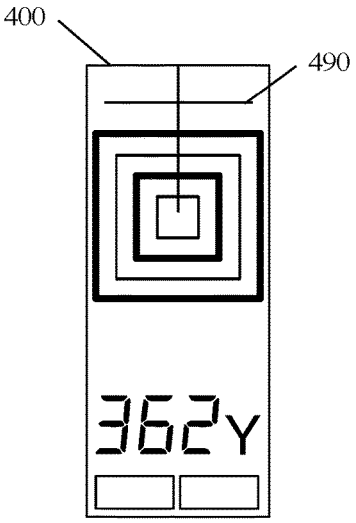
Figure 11D:
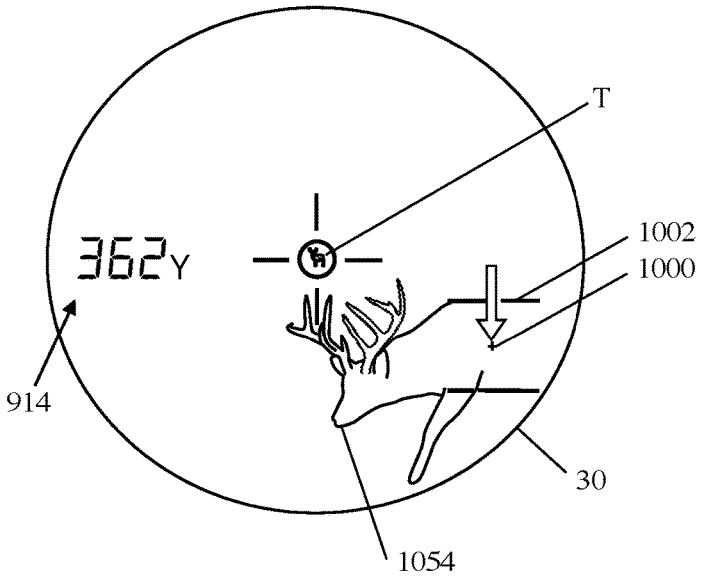

FIG. 11C shows the turret display device 400, when it has received a current distance of 362 yards.

Figure 11E:
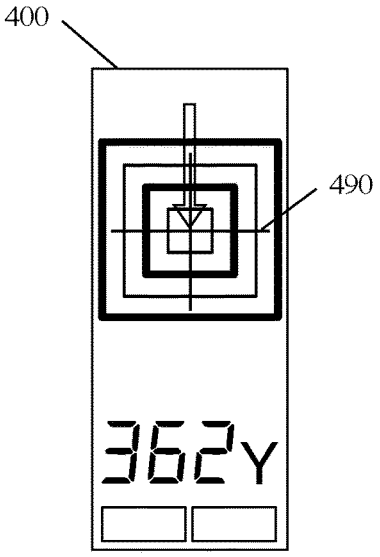

If the user has time, they may rapidly zero the scope for the new distance, in this case 362 yards, by turning the respective turrets, elevation turret 274 and windage turret 276, until the turret display cross hairs 490 are centered on the relative target icon 1120 as shown in FIG. 11E. The improved riflescope 302 is now zeroed at 362 yards and user can aim using the scope cross hairs 290 centered on the target T.

In an embodiment of an improved Relative Aiming Point Rangefinder, the rangefinder also receives turret position signals and adjusts the relative aiming point 1000 (FIG. 11D) in concert with the changes shown in FIG. 11E. The coordinated movement is illustrated with the arrows shown in both FIG. 11D and FIG. 11E. The arrows are illustrative of the movement and are not a display element of either display.

Figure 11F:
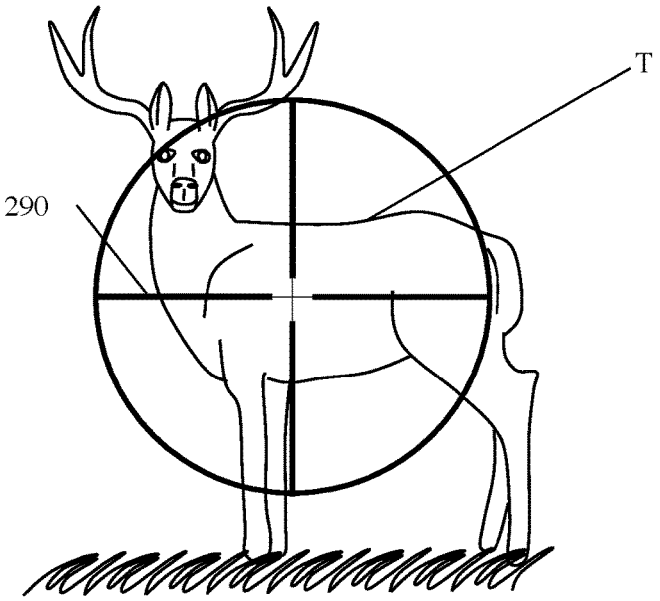

FIG. 11F illustrates that the user may aim at the target T simply by placing the scope cross hairs 290 where they want to hit the target T.

Advantages

Faster

The rapid zero technology provides the user with visual indications that do not require mathematical calculations in order to make adjustments to an improved riflescope's turrets. The user immediate sees an image in the turret display device, which is then replicated with the scope on the firing device. In other words, the user stays "right brained" allowing for rapid and accurate action.

Accurate

The rapid zero technology provides an accurate aiming point zeroed to a predetermined sight in distance.

Further, the user can rapidly zero the scope cross hairs based on any ranged distance.

Effective

The rapid zero technology provides an accurate aiming point that can the user can intuitively match.

Confidence

The rapid zero technology gives the user confidence that their aiming point is accurate.

The rapid zero technology gives the user confidence that the target will be hit.

This increased confidence will improve the user's performance and satisfaction.

Adjustable

The embodiments of these devices can be adjusted to be consistent with an individual user and associated firing device, for example the specific ammunition and scopes.

Lightweight

The enhanced features of the rapid zero technology do not add weight to the convention device.

Easy to Transport and Use

Devices containing the rapid zero technology are easy to transport and use.

CONCLUSION, RAMIFICATION, AND SCOPE

Although the invention has been described with reference to the preferred embodiments illustrated in the attached drawings, it is noted that equivalents may be employed and substitutions made herein without departing from the scope of the invention as recited in the claims.

Accordingly, the reader will see that the novel turret display devices, improved riflescopes, and improved rangefinder devices, and methods provide greater accuracy, effectiveness, and safety.

While the above descriptions contain several specifics these should not be construed as limitations on the scope of the invention, but rather as examples of some of the preferred embodiments thereof. Many other variations are possible. For example, the display can be manufactured in different ways and/or in different shapes to increase precision, reduce material, or simplify manufacturing. Further communications could be wired or wireless with various short range wireless communications technologies. The variations could be used without departing from the scope and spirit of the novel features of the present invention.

Accordingly, the scope of the invention should be determined not by the illustrated embodiments, but by the appended claims and their legal equivalents.

We claim:

1. A turret display device for rapidly zeroing a riflescope at a predetermined first distance, the riflescope having a windage turret, wherein the windage turret provides a turret position signal, the turret display device comprising:

a) a computing element, b) a memory, connected to the computing element, c) a wireless communications element, connected to the computing element, and d) a display, connected to the computing element, comprising:

i) turret display cross hairs, and ii) a target icon, wherein the display is separate from the view through the riflescope, wherein the target icon provides a relative reference for the turret display cross hairs, wherein, when the turret display device receives a turret position signal, the turret display cross hairs move to show the relative movement as indicated by the received turret position signal, and wherein the movement of the cross hairs based on the windage turret provides a wind speed indication.

2. The turret display device of claim 1 further comprising inputs, wherein a distance is entered into the turret display device, and wherein the turret display cross hairs move to show an aiming point relative to the target icon based on the entered distance.

3. The turret display device of claim 1, wherein, after a distance is received by the turret display device, the turret display cross hairs move to show an aiming point relative to the target icon based on the received distance.

4. The turret display device of claim 1 wherein the target icon of the display is a relative target icon comprising two or more squares having common centers.

5. The turret display device of claim 1 wherein the display further comprises a distance indicator.

6. The turret display device of claim 1 wherein the display further comprises a sight in indicator which is selectively activated to indicate a sight in distance.

7. The turret display device of claim 1 integrated into a smart phone, wherein the display is a display of the smart phone, wherein the smart phone display is a touch screen and provides inputs, wherein the wireless communications are wireless communications of the smart phone, and wherein the smart phone uses the wind speed indication to calculate wind correction a second distance different than the first distance.

8. The turret display device of claim 1 integrated into the riflescope, wherein the display is on a surface of a housing of the riflescope.

9. The turret display device of claim 8, wherein turret position signal is communicated via a wire.

10. The turret display device of claim 8, wherein turret position signal is communicated via the wireless communication.

11. The turret display device of claim 8, wherein a distance is entered into the turret display device, and wherein the turret display cross hairs move to show an aiming point relative to the target icon.

12. The turret display device of claim 8, further configured to wirelessly communicate with a rangefinder, wherein the first distance is received wirelessly from the rangefinder by the turret display device, wherein the turret display cross hairs move to show an aiming point relative to the target icon, and wherein the rangefinder uses the wind speed indication to calculate wind correction a second distance different than the first distance.

13. The turret display device of claim 1 integrated into a hand held rangefinder device, wherein the display is on a surface of a housing of the hand held rangefinder device, and wherein the rangefinder uses the wind speed indication to calculate wind correction a second distance different than the first distance.

14. The turret display device of claim 13, wherein the hand held rangefinder device is a relative aiming point rangefinder having a relative aiming point displayed relative to a reference image.

15. The turret display device of claim 14, wherein the relative aiming point rangefinder receives the turret position signal and adjusts the relative aiming point as the the windage turret is adjusted.

16. A method of calibrating the riflescope using the turret display device of claim 1, the comprising the steps of:

a) aiming scope cross hairs of the riflescope at a target, b) shooting a projectile at a predetermined sight in distance from the target with the scope cross hairs centered on the target creating a shot mark on the target, and c) moving the turret display cross hairs over the target icon to match a position of the shot mark relative to the target.

17. A method of zeroing the riflescope at any distance using the turret display device of claim 1, the comprising the steps of:

a) receiving the wind speed indication, wherein the turret display device moves the turret display cross hairs to show an aiming point relative to the target icon, b) turning at least the windage turret to center the turret display cross hairs on the target icon, whereby the user aims using scope cross hairs of the riflescope at the center of a target at the distance.

18. A riflescope having a windage turret for adjusting scope cross hairs, wherein the windage turret provides a turret position signal to a turret display device, the turret display device comprising:

a) a computing element, b) a memory, connected to the computing element, c) a wireless communications element, connected to the computing element, and d) a display, connected to the computing element, comprising:

i) turret display cross hairs, and ii) a target icon, wherein the display is separate from the view through the riflescope, wherein the target icon provides a relative reference for the turret display cross hairs, wherein, when the turret display device receives the turret position signal, the turret display cross hairs move to show the relative movement as indicated by the received turret position signal, and wherein the relative movement provides a wind indication.

19. The riflescope of claim 18 wherein the turret display device receives a distance wirelessly from a rangefinder.

20. The riflescope of claim 18 wherein the display cross hairs of the turret display device move to show an aiming point relative to the target icon based on a distance entered by a user or received from a rangefinder.

* * * * *